US006949010B2

(12) United States Patent
Light et al.

(10) Patent No.: US 6,949,010 B2
(45) Date of Patent: Sep. 27, 2005

(54) METHOD OF PROVIDING A DUAL USE GRAVESITE MARKER

(75) Inventors: Douglas J. Light, Indianapolis, IN (US); Jeffrey S. McGuire, Indianapolis, IN (US)

(73) Assignee: Ceramica, Inc., Indianapolis, IN (US)

( * ) Notice: Subject to any disclaimer, the term of this patent is extended or adjusted under 35 U.S.C. 154(b) by 10 days.

(21) Appl. No.: 10/453,167

(22) Filed: Jun. 3, 2003

(65) Prior Publication Data

US 2003/0192266 A1 Oct. 16, 2003

Related U.S. Application Data

(62) Division of application No. 10/094,665, filed on Mar. 11, 2002, now abandoned.

(51) Int. Cl.[7] ..... B24B 1/00

(52) U.S. Cl. ..... 451/28; 451/30; 451/38; 451/41

(58) Field of Search ..... 451/41, 29, 30, 451/31, 38, 39, 40

(56) References Cited

U.S. PATENT DOCUMENTS

| | | | | | |
|---|---|---|---|---|---|
| 1,455,882 | A | * | 5/1923 | Harding | 40/124.5 |
| 1,638,193 | A | | 8/1927 | Forwood | |
| 1,844,048 | A | | 2/1932 | Spreer | |
| 2,017,335 | A | | 10/1935 | Adams | |
| D102,517 | S | | 12/1936 | Seibert et al. | |
| 2,153,229 | A | | 4/1939 | Arkin | |
| 2,312,859 | A | | 3/1943 | Zentmyer | |
| 2,450,401 | A | * | 9/1948 | Thompson | 451/89 |
| 3,063,875 | A | | 11/1962 | Barry | |
| 3,441,362 | A | | 4/1969 | Streck | |
| 3,463,653 | A | | 8/1969 | Letter | |
| 3,604,172 | A | | 9/1971 | Matvey | |
| 3,608,220 | A | | 9/1971 | Fryrear | |
| 4,159,600 | A | * | 7/1979 | Kaminski | 451/31 |
| 4,285,149 | A | * | 8/1981 | Berryhill | 40/124.5 |
| 5,197,013 | A | | 3/1993 | Dundorf | |
| 5,845,436 | A | | 12/1998 | Nota | |
| 6,363,635 | B1 | | 4/2002 | England | |
| 6,385,499 | B1 | * | 5/2002 | Mattke et al. | 700/159 |
| 6,467,222 | B2 | * | 10/2002 | Barnes | 52/103 |

* cited by examiner

*Primary Examiner*—Timothy V. Eley
(74) *Attorney, Agent, or Firm*—Woodard, Emhardt, Moriarty, McNett & Henry LLP

(57) ABSTRACT

A temporary gravesite marker for use in identifying a gravesite until a permanent gravestone is available includes a marker tablet which has a generally rectangular solid form with an upper surface to be marked with alphanumeric characters providing information regarding the deceased. The marker tablet is fabricated from a durable material and includes an upper surface and a substantially parallel bottom surface, both of which are substantially flat. The preferred marker tablet has a two-to-one (2:1) aspect ratio and measures 5½ inches by 11 inches with a 1¹⁄₁₆ inch thickness. The density of the material selected, based upon the overall volume, yields a weight for the marker tablet of approximately ten pounds. The alphanumeric characters are inscribed into the upper surface of the marker tablet by means of a prepared stencil and by sandblasting. The information added to the marker tablet in order to create the temporary gravesite marker is designed so as to simulate the information which will be contained as part of the permanent gravestone.

1 Claim, 2 Drawing Sheets

METHOD OF PROVIDING A DUAL USE GRAVESITE MARKER

REFERENCE TO RELATED APPLICATION

The present application is a divisional patent application of U.S. patent application Ser. No. 10/094,665 filed Mar. 11, 2002 now abandoned entitled "TEMPORARY GRAVESITE MARKER" which is hereby incorporated by reference in its entirety.

BACKGROUND OF THE INVENTION

The present invention relates in general to gravesite markers or what might be referred to as gravestones, headstones, or monuments. More specifically, the present invention relates to the design and construction of a temporary gravesite marker which can be styled to simulate the final or permanent gravestone which will be used to mark and identify the grave.

The death of a loved one can come suddenly and unexpectedly, causing the family to hurriedly put funeral arrangements together. One of the decisions to be made, in many cases, is the selection and styling of a permanent gravestone. Even if the passing of a loved one is anticipated, such as when the individual is suffering from a long illness, funeral arrangements are not necessarily made in advance. Further, even if a gravestone style and informational content can be selected and decided upon fairly quickly, the final cutting, designing and stenciling may take weeks to complete. Some of the delay may be due to the time required and the simple backlog of earlier orders. The completion of the gravestone work may also be affected by what a particular cemetery or monument company has in stock as far as gravestone materials, colors, shapes, sizes, etc. Even if the desired gravestone is in stock, the addition of designs and letter etching or stenciling must still be done and this can take weeks to complete.

In order to address the problem of such time delays in having the final, permanent gravestone for a gravesite, cemeteries typically create what could best be described as a fairly crude, temporary gravesite marker. Such temporary markers may be nothing more than a small metal frame which receives selectively arranged letter tiles in order to spell out the surname of the deceased. These temporary markers, which are relatively thin (one-half (½) to one and one-half (1½) inches), are placed on the ground adjacent the gravesite. By limiting the overall thickness of these temporary markers such that their height above ground level is roughly one (1) inch, it allows the grounds crews or maintenance crews at the cemetery, when mowing the grass, to be able to run the lawnmower directly over the marker. While such temporary markers are not intended in any way to be disrespectful to the deceased, they are certainly not what would be considered pleasing in appearance or matching the style and presentation of the permanent gravestone to be positioned at a later time. No doubt to some family members these temporary metal gravesite markers, with their movable and replaceable letter tiles, can be depressing and to others these temporary markers may seem to trivialize the life and accomplishments of the deceased.

Consider for a moment the handling of a death by a funeral home, church, synagogue, etc. There is usually a great deal of attention paid to all of the details with some degree of pomp and circumstance to the proceedings, with attention to virtually every detail in a way that is intended to make the family of the deceased pleased with the treatment of their loved one and pleased with the respect which is being shown by the proceedings. At the end of this process, after the loved one is laid to rest, there is the placement of the permanent gravestone at the gravesite in the cemetery. Professionally cut, crafted, stenciled, and polished, all to the exact specifications and choices of the family, there is here as well an impressive presentation reflective of the life and accomplishments of the deceased.

What about the few weeks in between? What about the time following the funeral and prior to the time that the permanent gravestone is ready to be positioned? What respect is shown to the deceased in identifying and marking the gravesite as the final resting place? All that the gravesite receives for these few weeks is a reusable metal frame which may be rusty and which may have been reused hundreds of times and includes merely temporary and replaceable letter tiles which are also reused hundreds of times.

Having considered all of these issues, it was felt by the present inventors that something more for the deceased was in order, something which would balance and complement the pomp and circumstance of a professionally handled funeral and the placement of the permanent gravestone at the gravesite. What was desired was to replace the current style of temporary gravesite marker with something more lasting and respectful of the deceased. This desire on the part of the present inventors resulted in the conception of the present invention which is described and claimed herein. While the present invention is still a temporary marker, it includes permanent aspects, such as the lasting quality and durability of the materials which can be selected, the etching of the lettering, the size and the weight. It was decided to style the gravesite marker according to the present invention as a permanent keepsake for the family to keep once the permanent gravestone is ready.

The present invention provides a small replica of the permanent gravestone as far as the lettering, including font and content, albeit scaled down in size, as well as the overall arrangement of the lettering and the length-to-height aspect ratio. The selected material which is used is one which is permanent and lasting. The marker is smaller and light enough (less than sixteen (16) pounds) to be considered portable. Its preferred thickness is one (1) inch so that this temporary gravesite marker can be laid on the ground and will clear the lawnmower blades as the lawnmower runs over the marker. When the permanent gravestone is ready, the temporary gravesite marker of the present invention is presented to the family as a permanent keepsake.

The technology for the present invention has been available for years and the drawbacks with current temporary (metal) markers have been around even longer. Even with all of this, nothing similar to the present invention was ever envisioned, until now.

SUMMARY OF THE INVENTION

A temporary gravesite marker for use in identifying a gravesite until a permanent gravestone is available, according to one embodiment of the present invention, comprises a marker tablet having an upper surface for marking with alphanumeric characters, a bottom surface spaced apart from the upper surface, and a shape-defining outer peripheral wall extending between the upper surface and the bottom surface, the marker tablet having a dimensional volume and material density such that the weight of the marker tablet is between four (4) and sixteen (16) pounds and marking indicia applied to the upper surface.

One object of the present invention is to provide an improved temporary gravesite marker.

Related objects and advantages of the present invention will be apparent from the following description.

DESCRIPTION OF THE PREFERRED EMBODIMENTS

Figure 1:
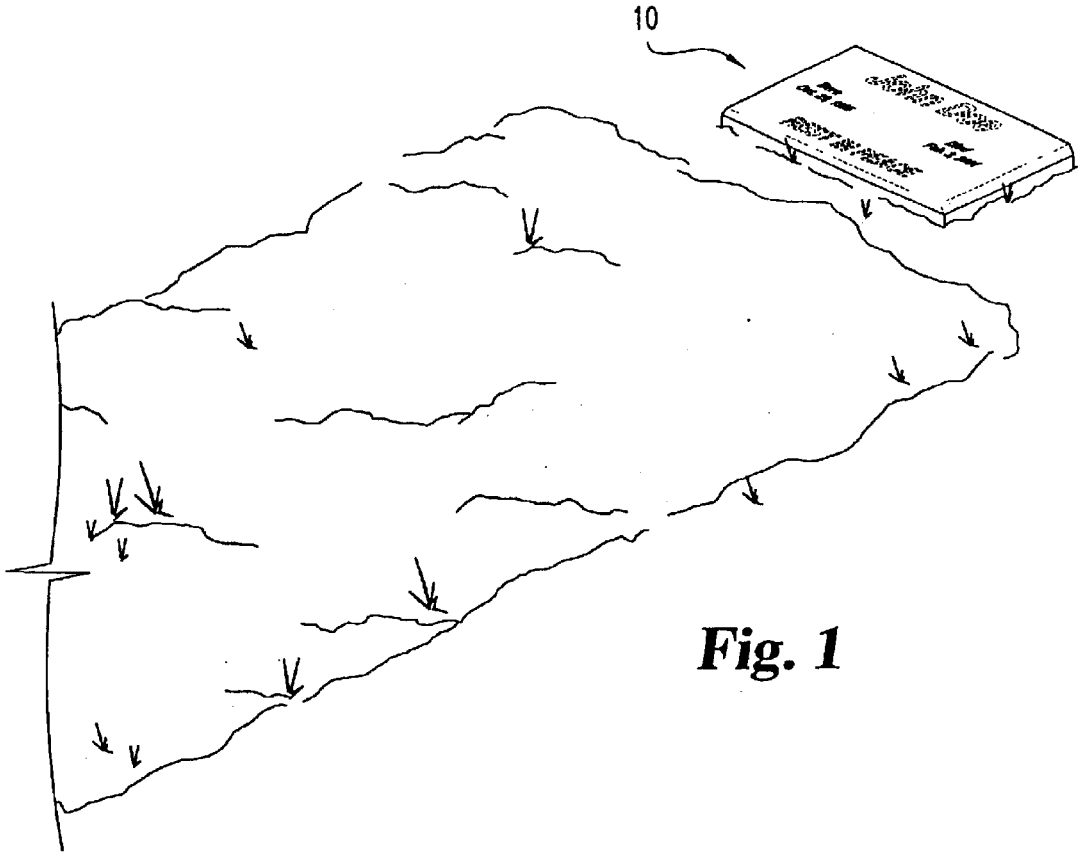
FIG. 1 is a perspective view of a temporary gravesite marker, as positioned at a gravesite, according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a "temporary" gravesite marker 10, according to the present invention. Marker 10 is actually constructed to be a permanent memento or keepsake which simulates the permanent gravestone to be placed at the gravesite. Accordingly, marker 10 has a size, shape, and weight that enables marker 10 to be considered as portable. Marker 10 is intended to be used by placing it on the ground at the gravesite in a cemetery, for example, with its upper surface 11 facing upright so as to be visible. Upper surface 11 includes identification information in the form of alphanumeric characters regarding the person buried at the corresponding gravesite. This information can include virtually any items which the family of the deceased would like to include as part of marker 10. It is expected that the included information will likely include the name of the deceased as well as the years (or dates) of birth and death. However, since the requested information is easily stenciled onto the upper surface 11 of marker 10, the information options for the family of the deceased are virtually limitless.

While the specifics of marker 10 will be described hereinafter, including material options and dimensional ranges, marker 10 actually begins with a unitary marker tablet which has been fabricated to the desired size and shape from a selected material. The desired information is then etched into the upper surface 11 of the marker tablet, typically by sandblasting through a prepared stencil (see FIG. 4) in order to create marker 10.

The importance and value of marker 10 can best be understood by understanding the entire process beginning with the funeral and ending with the placement of the permanent gravestone at the gravesite. Although the family of the deceased may have already ordered the permanent gravestone, including the layout of all desired information and any designs, the actual fabrication and lettering of the permanent gravestone may take several weeks to complete. In the interim, the gravesite should be marked in some appropriate fashion.

As described in the Background, one currently used style of temporary gravesite marker is a reused metal frame into which individual letter tiles are arranged. The frame and letter tiles may have already been used hundreds of times and the condition of such a marker is clearly suspect. In addition to the obvious disrespectful overtones of such crude markers, there is an obvious disparity in the pomp and circumstance of a properly conducted funeral service and the quality and styling of the final (permanent) gravestone. If these temporary gravesite markers were acceptable for the final form of a marker, then that is what would be used. Instead, the family of the deceased wants a larger, permanent gravestone which will have the beauty, quality, and durability to last for years. This is partly why granite is so often selected and this is why the lettering is etched or engraved directly into the stone. In view of this, why should the family of the deceased have to settle for the crude, metal frame, temporary marker? The answer is that the family of the deceased no longer has to settle for the status quo. The family of the deceased now has a better option for the temporary gravesite marker, and that better option is the gravesite marker 10 according to the present invention.

Regarding the material options for marker 10, the softer limestones, such as oolitic, are not suitable, nor is conventional concrete or cast stone. Ceramic tiles are, at most, one-half (½) inch thick, and thus very likely to crack if stepped on while placed on an uneven surface. Bricks are too thick for the cemetery mowers to pass over, and three-fourths (¾) inch thick granite might be strong enough, but is not as cost effective as other materials. Nevertheless, if cost is not a primary consideration, granite would be an option. Similar issues exist with marble, from the cost perspective, and in addition, marble is suspect from a long-term weathering perspective.

The ideal material for marker 10 is believed to be dolomitic limestone, a relatively obscure material which is quarried in Canada. While there may be various sources of supply for dolomitic limestone, at least one commercially available source provides this material under the proprietary trade name of "ADAIR STONE". The ADAIR STONE material has a compressive strength of approximately 30,000 psi and an extremely low absorption rate of approximately 1.25 percent. When this material is used for exterior construction purposes, the source of origin warrants that it will last for approximately 350 years.

A clear advantage of this ADAIR STONE material and a clear advantage of dolomitic limestone generally is its lower cost compared to granite and marble, at least 11 smaller pieces. The source of origin for ADAIR STONE offers this product through distributors in North America and one of the standard sizes for the smaller pieces which are offered, converting from metric dimensions, are approximately eleven (11) inches long by five and one-half (5½) inches wide or high and two and one-four (2¼) in thickness. The top edges of these rectangular solids are beveled and the top surface which would be etched or chiseled with alphanumeric characters is sanded to a smooth finish. The preferred dimensions, based on standard piece sizes of approximately 11 inches by 5 and one-half inches provides a desirable 2:1 rectangular aspect ratio.

In order to process these standard pieces of dolomitic limestone, each piece or tablet is cut in a co-planar direction so as to separate the two and one-fourth inch thickness into two equal pieces. In order to complete the fabrication of the second piece (lower half), its exposed edges are beveled and the upper surface is sanded smooth to a comparable finish to that of the original piece, as received. The result is two virtually identical marker tablets cut from the supplied rectangular solid and both marker tablets are suitable for inscribing, all at a very low cost.

Dimensionally it is conceivable that one might want a temporary gravesite marker which is larger than the eleven inches by five and one-half inches, such as eighteen by nine (18×9) inches, if the 2:1 aspect ratio is retained, or possibly eighteen by twelve (18×12) inches for a slightly different rectangular shape. If the thickness of approximately one inch to one and one-eighth (1⅛) inch is maintained, the larger sizes can pose a concern with regard to possible breakage. The longer the length, the greater the span and moment arm and thus the greater risk for breakage.

In the reverse direction, considering a smaller size, such as eight (8) inches by four (4) inches, the amount of information to be inscribed on the upper surface of the marker needs to be considered. Depending on how much information is desired, such as the name of the deceased, the dates of birth and death, and conceivably other information or quotations, a smaller size, such as eight inches by four inches may not provide enough surface area to include all of the desired information in a character height that will be easily readable.

While marker 10 preferably has a generally-rectangular shape with a 2:1 aspect ratio, the actual final shape for marker 10 is an option since the preferred material set forth above can be cut to the desired shape. Marker 10 is roughly one inch in overall thickness so that, when laid on the ground adjacent the gravesite, it will lay low enough so that there is clearance between the upper surface 11 and the blade(s) of any lawnmowers used by the grounds or maintenance crews at the cemetery. When the larger, permanent gravestone is ready to be placed at the gravesite, temporary (portable) marker 10 is given (or sold) to the family of the deceased as a small, permanent memento or keepsake. This smaller marker 10 can be placed in the home as a reminder of the deceased and may substitute in a small way for personal visits to the gravesite, something which is not always that convenient when family members reside out of state or where schedules do not permit personal visits to the gravesite. Marker 10 can also be placed in a garden or yard as a type of personal and private memorial.

Figure 2:
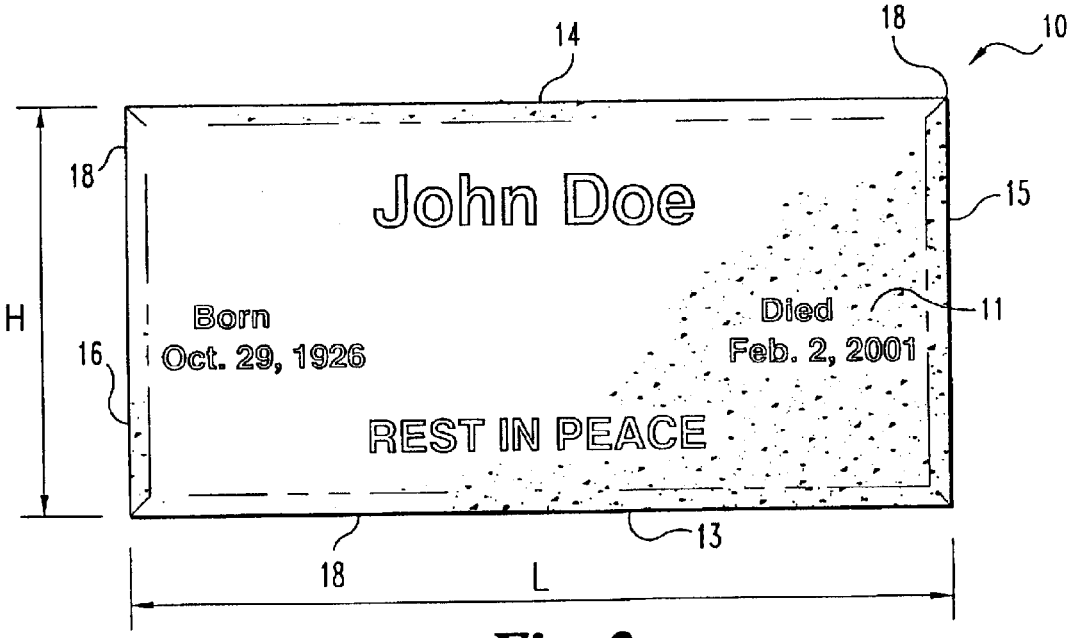
FIG. 2 is a top plan view of the FIG. 1 temporary gravesite marker.
Figure 3:
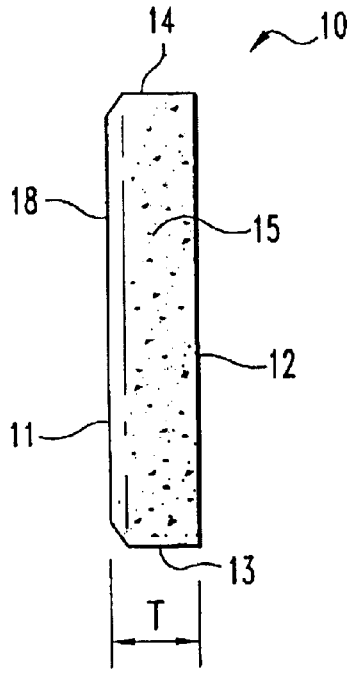
FIG. 3 is a side elevational view of the FIG. 2 temporary gravesite marker.

With reference to FIGS. 2 and 3, some of the details of marker 10 are illustrated and will be described. Marker 10, which begins as a marker tablet, includes a substantially flat upper surface 11, a substantially flat bottom surface 12 which is generally parallel to surface 11, length sides 13 and 14, and width sides 15 and 16. Sides 13–16 are each substantially flat with sides 13 and 14 being substantially parallel to each other and with sides 15 and 16 being substantially parallel to each other. Sides 13–16 are substantially perpendicular to surfaces 10 and 11 and, as such, maker 10 can best be described as a rectangular solid, in the preferred embodiment which is illustrated. It is also noted that dividing edges 18 are beveled in order to remove any sharp edges. The edges and corners may alternatively be rounded or radiused.

The thickness (T) of marker 10 which corresponds to the distance between surfaces 10 and 11, is preferably set at one and one-sixteenth (1 1/16) inch in order to strike a balance between what is required for lawnmower clearance and what is desired as to overall weight, feel, and durability. Starting with a two and one-fourth (2¼) inch thick tablet and a saw blade that is roughly one-eighth (⅛) inch thick, allowing for vibration and chatter, the two pieces that result are each one and one-sixteenth (1 1/16) inch thick. A thinner marker would obviously clear the mower blades, but for the same length, height, and thickness dimensions would have less weight and, as such, might not provide the same feel of lasting durability. The risk of cracking also has to be considered as the thickness decreases. Since different length (L) and height (H) dimensions can be selected, and since different materials with different material densities can be used for marker 10, it is helpful to select a desired overall weight which is heavy enough to be used as a temporary marker so that it will remain in place, but not too heavy to lose its concept of portability and thus its value as a lasting memento or keepsake.

While an overall weight of between four and sixteen pounds is acceptable and satisfies the foregoing criteria, the preferred weight for marker 10 is ten pounds. For a rectangular solid of one and one-sixteenth (1 1/16) inch thickness, the equation:

$$(L)(H)(1\tfrac{1}{16}\text{ inches})(\rho)=10.0\text{ pounds} \qquad \text{equation 1}$$

needs to be satisfied where ρ (rho) is the density of the selected material expressed in pounds per cubic inch. It will be seen that when either the length dimension or the height dimension changes, for the same material density and for the same thickness, the other dimension must change to satisfy the equation in order to achieve the preferable weight of ten pounds. If the material choice changes and, as a result, the density changes, either the length dimension or the height dimension or both will need to change in order to satisfy the equation and the ten pound target weight. Preferably, the material density ranges from 0.07 lb./in$^3$ to 0.20 lb./in$^3$, with the preferred length dimension ranging from 8 to 14 inches and the preferred height dimension ranging from 4 to 7 inches, for example. If an alternative shape is selected for the outline shape of marker 10, such as an oval, circle, or trapezoid, the corresponding area formula must be used, replacing the (L)(H) portion of equation 1. As indicated, the thickness dimension is preferably set at 1 1/16 inches, but could be larger if lawnmower blade clearance was not a concern or smaller if a thinner marker was desired.

Figure 4:
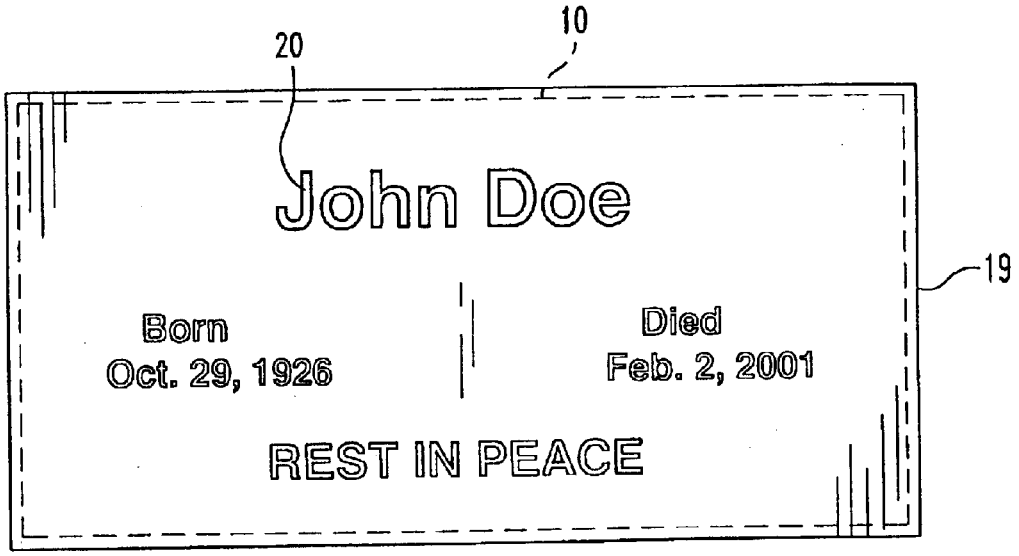
FIG. 4 is a top plan view of a stencil applied to a temporary gravesite marker, prior to etching the desired alphanumeric characters into the temporary gravesite marker, according to the present invention.

With reference to FIG. 4, it is to be understood that the letters and numbers which are etched or engraved into surface 11 of marker 10 are actually created by the use of a stencil 19 and sandblasting through the stencil apertures 20. The stencil material blocks the sand from having any effect on the other portions of surface 11 and the sand that is allowed to impinge on the surface 11, by passing through apertures 20, chips away at the marker material and actually etches or chisels the selected letters and numbers into surface 11. While the depth of the "chiseled" letters and numbers is a variable, depending on velocity, sand grain size, and the time duration, the ideal depth for the lettering and numbering into surface 11 is one-sixteenth (1/16) of an inch.

Consistent with the teachings of the present invention, it is intended that the information which is etched into surface 11 will be virtually the same as that which is designed for the permanent gravestone. While not all of the information to be included on the permanent gravestone will actually be transferred to marker 10, the basic information as to the name of the deceased, the dates of birth and death, and possibly some other information will be included. In addition to the actual information which is included as part of marker 10, there will be type of simulation between the larger gravestone and the smaller marker 10 version and this simulation will extend to font style and the overall arrangement and could even include some designs. A further aspect of the simulation will be the fact that, to the extent possible, marker 10, assuming the rectangular solid form, will have a length-to-height aspect ratio which will be the same as the length-to-height aspect ratio of the permanent gravestone. In this way, the simulation of the lettering can have a similar arrangement with similar spacing between the top, bottom, and side edges.

The selected material for marker 10 can also be made in order to simulate that of the permanent gravestone as to color and texture. In addition to the aspect ratio, the overall shapes can be virtually the same, if desired. In this way, the family of the deceased will have a keepsake marker which is virtually a miniature, albeit preferably limited to ten pounds, of the permanent gravestone. This high degree of similarity will only add to the memories and enhance the value and importance of marker 10.

With regard to the method of stenciling or etching the alphanumeric characters into surface 11, it should be understood that once the permanent gravestone is selected and the information provided, all of these details can be provided to the individual or company which will be preparing marker 10. In effect, the company responsible for fabrication of the permanent gravestone can provide information as to the length and height aspect ratio, the material selected, the color of the material, and can provide a detailed layout of exactly what letters and numbers will be etched into the surface and the arrangement of those alphanumeric characters. Once the information is available, the party responsible for making marker 10 can load this information into a software program which allows the corresponding stencils to be prepared in the desired font, size, arrangement, and spacing. Once the stencil is available, it is simply applied to the surface of the marker tablet and through a sandblasting technique, the alphanumeric characters are etched or chiseled into surface 11 to complete the simulation of the permanent gravestone.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of providing a dual use gravesite marker for survivors of a deceased individual, said method comprising the following steps:

(a) accepting an order for a permanent gravesite marker;

(b) offering a replica temporary gravesite marker;

(c) fabricating said replica temporary gravesite marker;

(d) placing said replica temporary gravesite marker at a gravesite for a limited period of time;

(e) fabricating said permanent gravesite marker;

(f) replacing said replica temporary gravesite marker with said permanent gravesite marker; and (g) presenting said replica temporary gravesite marker to one or more of said survivors as a keepsake.

* * * * *